US005505117A

United States Patent [19]

Dunlap et al.

[11] Patent Number: 5,505,117

[45] Date of Patent: Apr. 9, 1996

[54] BRAIDED SLEEVE

[76] Inventors: Daryl S. Dunlap, 5 S. Academy St., Franklinville, N.Y. 14737; Joseph M. Lampke, 5 Pioneer Cir., Delevan, N.Y. 14042; Kevin Maguire, 3002 Clinton Ave., Cleveland, Ohio 44113

[21] Appl. No.: 931,581

[22] Filed: Aug. 18, 1992

[51] Int. Cl.[6] ..... D04C 1/02

[52] U.S. Cl. ..... 87/1; 87/9

[58] Field of Search ..... 87/1, 5, 6, 7, 8, 87/9, 34

[56] References Cited

U.S. PATENT DOCUMENTS

| | | | |
|---|---|---|---|
| 2,983,182 | 5/1961 | Shobert | 87/34 |
| 4,754,685 | 7/1988 | Kite et al. . | |
| 4,862,922 | 9/1989 | Kite III . | |
| 4,870,887 | 10/1989 | Tressler et al. . | |
| 4,877,660 | 10/1989 | Overborgh et al. . | |
| 4,891,256 | 1/1990 | Kite, III et al. . | |
| 4,929,478 | 5/1990 | Conagham et al. . | |
| 4,939,819 | 7/1990 | Moyer . | |
| 4,946,722 | 8/1990 | Moyer . | |
| 5,186,992 | 2/1993 | Kite | 87/8 X |

*Primary Examiner*—Joseph J. Hail, III

*Attorney, Agent, or Firm*—Reinhart, Boerner, Van Deuren, Norris & Rieselbach

[57] ABSTRACT

An expandable braided sleeve having an acrylic resin coating on its individual filaments. The braided sleeve can be expanded by pushing its ends inwardly toward each other. The resin coating on the filaments of the braided sleeve creates friction that causes the expanded braided sleeve to retain its expanded shape even when the ends of the sleeve are released. This makes it easier to install the braided sleeve onto a wire bundle. Once the expanded braided sleeve is in place over the wire bundle, the ends of the sleeve are pulled apart to return the sleeve to its narrow or unexpanded shape. The increased friction provided by the resin coating has the further effect of avoiding fraying at the ends of the braided sleeve.

10 Claims, 1 Drawing Sheet

BRAIDED SLEEVE

BACKGROUND OF THE INVENTION

1. Field of the Invention

This invention relates generally to expandable braided sleeves and, more particularly, to expandable braided sleeves formed of monofilament plastic fibers. The invention provides an expandable braided sleeve that, when pressed inwardly at its ends, expands and retains its expanded form until it is subsequently pulled at its ends to return it to its unexpanded form.

2. Description of the Prior Art

Braided plastic sleeves formed of monofilament plastic fibers are widely used as an outer sheath for electrical wire bundles. Such sleeves, which are typically formed of polyester filaments, make use of the filaments' natural "memory," i.e., the tendency of the filaments to return to their original shape when a distorting force is no longer applied. Typically, when the ends of an expandable braided sleeve are pushed axially inwardly toward each other, the diameter of the sleeve expands. If the ends are released, the sleeve automatically springs back to its unexpanded, narrow diameter form. The sleeve is inserted onto a wire bundle, for example, by simultaneously pressing the sleeve ends inwardly toward each other while at the same time threading the expanded sleeve onto the wire bundle. Once in place, the sleeve ends are released and the sleeve contracts tightly around the bundle. A degree of dexterity and skill is required to install such an expandable braided sleeve.

Because of their braided nature, expandable braided sleeves have a tendency to unravel or fray at their ends. One solution to this problem has been to cut the braided sleeve with a heated blade, which has the effect of melting and partially fusing or welding the individual filaments together at their ends. Although this is effective in avoiding fraying, it does have the effect of keeping the sleeve from expanding at its ends unless the "welds" between the individual filaments are manually broken immediately prior to use. This is an "extra step" that takes time, reduces convenience and makes the expanded braided sleeve somewhat more difficult and time consuming to use.

Examples of various braided sleeves are found in U.S. Pat. No. 4,870,887, which issued to Tresslar, et al. on Oct. 3, 1992 and U.S. Pat. No. 4,754,685, which issued to Kite, et al. on Jul. 5, 1988.

SUMMARY OF THE INVENTION

The invention provides an expandable braided sleeve that included a plurality of filaments arranged in tubular criss-cross manner so as to be displaceable between a first unexpanded position, wherein the diameter of the sleeve is at a minimum and the length of the sleeve is at a maximum, and a second expanded position, wherein the diameter of the sleeve is at a maximum and the length of the sleeve is at a minimum. The sleeve further includes a friction enhancing coating between adjacent ones of the criss-crossed filaments for maintaining the coefficient of friction between adjacent ones of the criss-crossed filaments sufficiently high as substantially to resist the natural tendency of the criss-crossed filaments to return from the second expanded position to the first unexpanded position. This allows the braided sleeve to retain its expanded form even when inwardly directed forces are not applied to the ends of the sleeve.

The invention also provides an expandable braided sleeve including a plurality of filaments arranged in tubular criss-crossed manner and further including an acrylic resin coating over the filaments.

The invention also provides a method of treating an expandable braided sleeve so as to enable the braided sleeve to retain an expanded form without the continuous presence of inwardly directed forces at the ends of the braided sleeve. The method includes the steps of expanding the braided sleeve, coating the expanded braided sleeve with a water-based acrylic resin mixture, and heating the expanded braided sleeve to dry the acrylic resin mixture and thereby leave an acrylic resin coating on the filaments of the braided sleeve.

It is an object of the present invention to provide a new and improved expandable braided sleeve.

It is a further object of the present invention to provide a new and improved expandable braided sleeve that can be easily and readily positioned over a wire bundle or other substrate.

It is a still further object of the present invention to provide an expandable braided sleeve that can retain its expanded shape without the need for constant axially directed forces applied at its ends.

It is a still further object of the present invention to provide an expandable braided sleeve that resists fraying at its ends while at the same time permitting free expansion at its ends.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
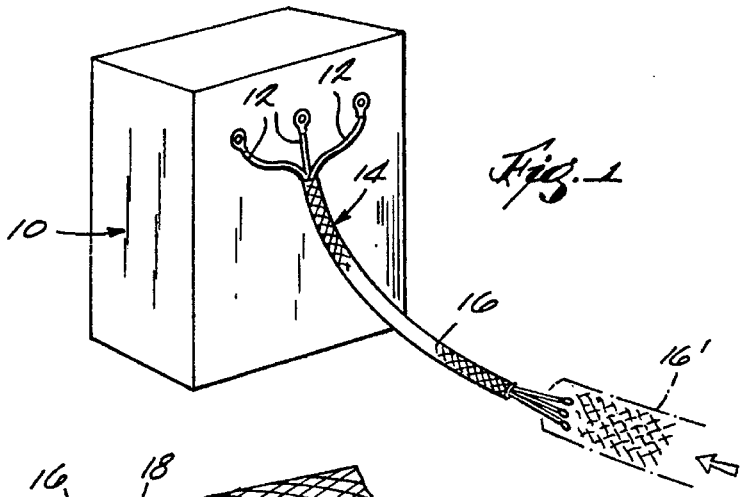
FIG. 1 is a perspective view of an electrical device having an electrical wire bundle over which an expandable braided sleeve embodying various features of the invention has been placed.

Referring to the drawings, and, in particular, to FIG. 1, an electrical device 10 having a plurality of electrical wires 12 connected thereto is shown. The individual electrical wires 12 are arranged into a bundle 14, and an expandable braided sleeve 16 embodying various features of the invention is installed over the wires 12 to arrange and hold the wires in a tight, neat bundle or cable.

Figure 2:
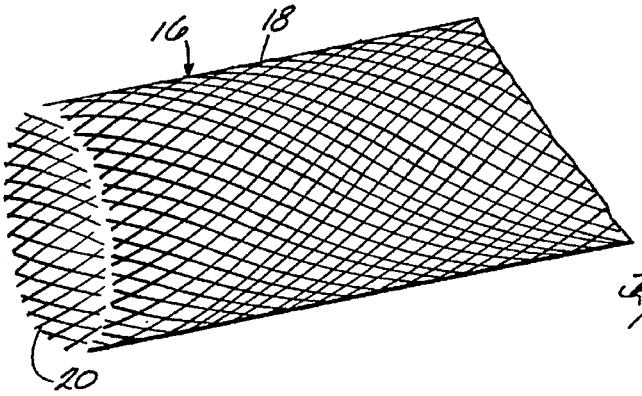
FIG. 2 is a perspective view of one end of the expandable braided sleeve shown in FIG. 1.

The braided sleeve 16 comprises a plurality of monofilament fibers 18 arranged in tubular criss-cross manner as best seen in FIG. 2. Because of the natural "memory" of the individual filaments 18 (i.e., the tendency to return to an undistorted, original form), and because of the braided nature of the tubular sleeve 16, the tubular sleeve 16 can be manipulated between a first, unexpanded position, wherein the diameter of the sleeve 16 is at a minimum and the length of the sleeve 16 is at a maximum, and a second, expanded position, wherein the diameter of the sleeve 16 is at a maximum and the length of the sleeve 16 is at a minimum. Referring to FIG. 1, the braided sleeve 16 (as shown in its entirety on the wire bundle) is in the first or unexpanded position. The partial sleeve 16' (shown in phantom) depicts the sleeve in the second or expanded position and illustrates how, when so expanded, the sleeve 16' can be threaded onto the wire bundle 14.

Figure 3:
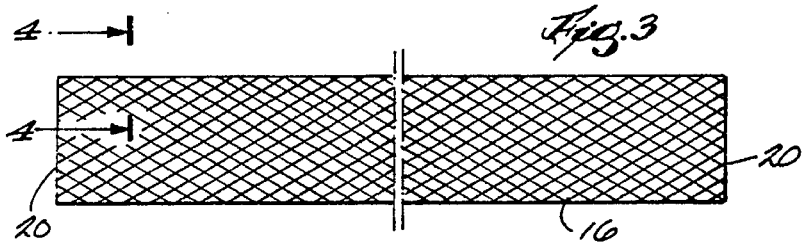
FIG. 3 is a side elevation view of the expandable braided sleeve in an unexpanded condition.
Figure 4:
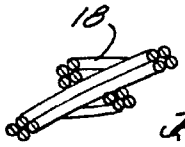
FIG. 4 is a cross-sectional view of the unexpanded braided sleeve shown in FIG. 3 taken along line 4—4 thereof.
Figure 5:
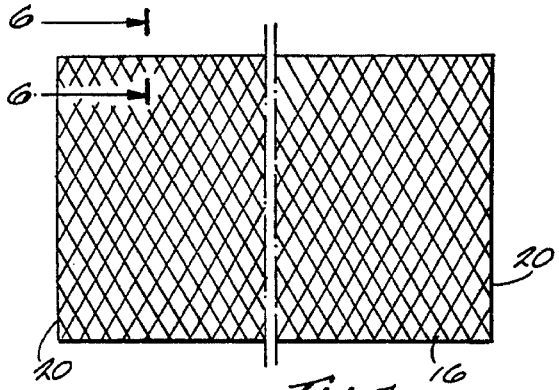
FIG. 5 is a side elevation view of the expandable braided sleeve in an expanded condition.

The difference between the first, or expanded, and the second, or unexpanded, positions can be seen by reference to FIGS. 3–6. In FIGS. 3 and 4, the sleeve 16 is in an unexpanded state and has a relatively narrow diameter and a relatively long length. In FIG. 2, the sleeve is in an expanded state and is of relatively shorter length and larger diameter. The changes in the length and diameter of the sleeve 16 are accommodated by changes in the angles at which the criss-crossed filaments 18 within the sleeve 16 cross each other.

Ordinarily, the braided sleeve 16 is manufactured so that, when no external forces are applied, the sleeve 16 remains in the first or unexpanded position. The sleeve 16 is expanded by applying inwardly directed forces to the ends 20 of the sleeve 16, i.e., by pushing the ends 20 in toward each other. When the ends are released, the natural "memory" of the filaments 18 causes the sleeve 16 to spring back to the first or unexpanded position.

Such a braided sleeve as heretofore described is commercially available from various sources, for example, from Atkins and Pearce of Covington, Ky. under the designation "Expandable Monofilament Sleeving," or from the Bentley-Harris Manufacturing Company of Lionville, Pa.

Figure 6:
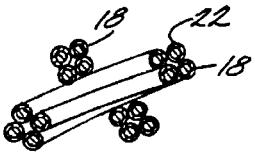
FIG. 6 is cross-sectional view of the expanded braided sleeve shown in FIG. 5 taken along line 6—6 thereof.

In accordance with one aspect of the invention, the braided sleeve 16, after it has been braided, is further treated so that the sleeve 16, once it is expanded, will remain in the expanded position even after the ends 20 are released. This greatly simplifies the task of inserting the sleeve 16 onto the wire bundle 14 as it eliminates the need to continue pushing the ends 20 of the sleeve 16 toward each other while at the same time trying to thread the sleeve 16 onto the bundle 14. In the illustrated embodiment, the further treatment comprises applying a coating 22 (FIG. 6) to the individual filaments 18 of the sleeve 16 to increase the coefficient of friction between the individual filaments 16 as they cross over each other. (It will be appreciated that the coating 22 shown in FIG. 6 is greatly exaggerated and in reality is extremely thin). To be effective, the coefficient of friction between crossing filaments 18 must be such that the resulting friction is sufficient to overcome the forces developed by the filaments' natural tendency to return to their normal, undistorted form.

Preferably, the coating 22 that is applied to the braided sleeve 16 comprises an acrylic resin such as that obtainable from Rohm and Haas under the name "Rhoplex AC 1230."

Preferably, the acrylic resin is thinned or mixed with water at the ratio of four parts of water to one part of resin by volume.

Preferably, the acrylic resin coating 22 is applied to the braided sleeve 16 in the following manner: First, the untreated braided sleeve 16 is cut to a suitable length (e.g., three feet) and is threaded onto a steel mandrel having a diameter corresponding to the desired expanded diameter of the braided sleeve 16. Next, the mandrel and the expanded braided sleeve 16 are dipped in the mixture of water and acrylic resin. Next, the mandrel and the expanded braided sleeve are removed from the water/resin mixture and are dried, for example by being baked for two minutes at 350° F. This has the effect of driving off the water and leaving a dry acrylic resin coating 22 on the filaments 18 of the braided sleeve 16. Once dry, the braided sleeve 16 is removed from the mandrel and is preferably pulled at its ends 20 to return it to its unexpanded, reduced diameter form. The treated braided sleeve 16 can then be cut into still shorter lengths or can be packaged and distributed without further processing. Alternatively, the treated braided sleeve 16 can be cut and distributed in its expanded form.

In use, when the ends 20 of the treated braided sleeve 16 are pushed toward each other, the sleeve 16 expands. However, when the ends 20 are released, the sleeve 16 retains its expanded form and does not snap back to its unexpanded form as it would had it not been treated with the acrylic resin coating 22. The expanded sleeve 16 can, however, be returned to its unexpanded form by pulling the ends 20 of the sleeve away from each other. The ability of the braided sleeve 16, when so treated, to retain its expanded form greatly simplifies the task of installing the sleeve 16 onto a wire bundle 14. A further benefit is that the increased friction between the criss-crossed filaments 18 resists fraying at the ends of the sleeve 16 and contributes to a neater installation.

It is believed that the particular acrylic resin coating, the ratio of water to acrylic resin, and the drying conditions (i.e., the temperature and time) are not critical and that the beneficial results of the invention are obtained through the resulting increase in the coefficient of friction between the criss-crossed filaments. Accordingly, the resins, mixing ratios and drying conditions herein described are viewed as illustrative rather than limiting.

The inventions also useful in connection with filaments formed of materials other than polyester. For example, the invention can also be used with filaments formed of fire retardant polyester, Nylon or Halar.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. An expandable braided sleeve comprising:

a plurality of filaments arranged in tubular criss-cross manner so as to be displaceable between a first unexpanded position wherein the diameter of said sleeve is at a minimum and the length of said sleeve is at a maximum and a second expanded position wherein the diameter of said sleeve is at a maximum and the length of said sleeve is at a minimum; and friction enhancing means between adjacent ones of said criss-crossed filaments for maintaining the coefficient of friction between adjacent ones of said criss-crossed filaments sufficiently high as substantially to resist the natural tendency of said criss-crossed filaments to return from said second expanded position to said first unexpanded position so that externally applied axial forces are required in order to return said sleeve from said second expanded position to said first unexpanded position.

2. An expandable braided sleeve as defined in claim 1 wherein said friction enhancing means comprises a coating on said filaments.

3. An expandable braided sleeve as defined in claim 2 wherein said coating comprises an acrylic resin.

4. An expandable braided sleeve as defined in claim 3 wherein said filaments are formed of polyester.

5. An expandable braided sleeve as defined in claim 4 wherein said acrylic resin coating is deposited by means of immersing the polyester filaments in a water based mixture of the acrylic resin and thereafter drying the filaments to drive off the water and leave behind the acrylic resin.

6. A method of treating an expandable braided sleeve so as to enable said braided sleeve to retain an expanded form without the continuous presence of inwardly directed forces on the ends of the braided sleeve, said method comprising the steps of:

expanding the braided sleeve;

coating the expanded braided sleeve with a water-based acrylic resin mixture; and drying said expanded braided sleeve to remove said water and thereby leave an acrylic resin coating on the filaments of the braided sleeve.

7. A method as defined in claim 6 herein the braided sleeve is dried by means of baking the braided sleeve to drive off the water.

8. A method as defined in claim 7 comprising the step of providing a mandrel having a dimension substantially greater than the unexpanded dimension of the braided sleeve.

9. A method as defined in claim 8 wherein said step of expanding the braided sleeve comprises placing the braided sleeve onto the mandrel.

10. A method as defined in claim 8 further comprising the step of removing the dried, expanded braided sleeve from the mandrel and thereafter pulling the ends of the dried braided sleeve to return the dried braided sleeve to an unexpanded state.

* * * * *